US009528234B1

(12) United States Patent
Pigeon

(10) Patent No.: US 9,528,234 B1
(45) Date of Patent: Dec. 27, 2016

(54) FRONT RETRACTING PLOW WITH SLIDING BLADE SECTIONS

(71) Applicant: Norbert Pigeon, Ste-Madeleine (CA)

(72) Inventor: Norbert Pigeon, Ste-Madeleine (CA)

(73) Assignee: EQUIPEMENT VTC MFG INC, St-Paul-d'Abbotsford, Quebec (CA)

( * ) Notice: Subject to any disclaimer, the term of this patent is extended or adjusted under 35 U.S.C. 154(b) by 0 days.

(21) Appl. No.: 15/163,019

(22) Filed: May 24, 2016

(51) Int. Cl.
*E01H 5/06* (2006.01)
*E01H 5/12* (2006.01)
*E02F 3/76* (2006.01)

(52) U.S. Cl.
CPC ..... *E01H 5/065* (2013.01); *E01H 5/062* (2013.01); *E01H 5/066* (2013.01); *E01H 5/12* (2013.01); *E02F 3/76* (2013.01)

(58) Field of Classification Search
CPC ..... E01H 5/062; E01H 5/065; E01H 5/066; E01H 5/067; E01H 5/12; E02F 3/76
USPC ..... 172/222, 228, 815, 314, 820, 618, 628; 37/216, 218, 281, 274
See application file for complete search history.

(56) References Cited

U.S. PATENT DOCUMENTS 204,031 A * 5/1878 Gruntler ..... E01H 8/04 15/54
561,980 A * 6/1896 Fick ..... E01H 8/04 37/205
1,060,548 A 5/1912 Haralson
1,544,983 A * 7/1925 Heinzen ..... E01H 5/066 37/274
1,672,490 A * 6/1928 Herchert ..... E01H 5/02 37/274
1,721,262 A * 7/1929 Snow, Jr. ..... E01H 5/06 37/271
1,743,969 A * 1/1930 Heinzen ..... E01H 5/067 192/109 D
2,116,351 A * 5/1938 Jones ..... E01H 5/062 37/233
2,690,902 A * 10/1954 Ream ..... E01H 5/12 172/40
2,962,821 A * 12/1960 Peitl ..... E01H 5/062 172/657

(Continued)

FOREIGN PATENT DOCUMENTS

CA 2397309 2/2004
CN 1831247 B 5/2010

(Continued)

OTHER PUBLICATIONS http://arizonafarmequipment.com/hla-snow-pushers.html.
http://www.metalpless.com/DixRaisons.

*Primary Examiner* — Jamie L McGowan
(74) *Attorney, Agent, or Firm* — Fraser Clemens Martin & Miller LLC; James D. Miller

(57) ABSTRACT

A front retracting plow comprising a vehicle mount for mounting the plow ahead of a tractor vehicle, a stationary intermediate blade mounted to the vehicle mount and at least one pair of opposite first and second relatively slidable lateral blades for travel in independently controlled fore and aft paths parallel to each other, and a pivotal linkage arm assembly interconnecting the at least one pair of lateral blades and the intermediate blade and for continuous sliding operational motion of the lateral blades parallel to one another in opposite directions wherein a laterally continuous forward ground scraping action is achieved.

10 Claims, 9 Drawing Sheets

(56) References Cited

U.S. PATENT DOCUMENTS

| | | | | | |
|---|---|---|---|---|---|
| 3,028,692 | A * | 4/1962 | Brock | E01H 5/065 | 15/245 |
| 3,387,890 | A * | 6/1968 | Haynes | E02F 3/405 | 172/40 |
| 3,477,151 | A * | 11/1969 | Zanella | E01H 5/065 | 172/815 |
| 3,798,805 | A * | 3/1974 | Hancock | E02F 3/64 | 172/701.1 |
| 4,259,794 | A | 4/1981 | Rath | | |
| 4,403,430 | A * | 9/1983 | Valditerra | E01B 27/021 | 37/104 |
| 4,667,426 | A * | 5/1987 | Howard | E01H 5/065 | 172/816 |
| 4,802,293 | A * | 2/1989 | Smith | E02F 5/223 | 172/787 |
| 5,048,207 | A | 9/1991 | Verseef | | |
| 5,603,172 | A | 2/1997 | Maher | | |
| 5,697,731 | A * | 12/1997 | Bonds | E01C 19/00 | 172/815 |
| 5,819,444 | A * | 10/1998 | Desmarais | E01H 5/065 | 172/782 |
| 6,108,946 | A | 8/2000 | Christy | | |
| 6,877,258 | B2 * | 4/2005 | Frey | E01H 5/065 | 37/274 |
| 7,578,078 | B2 * | 8/2009 | Gandolfi | E01H 5/066 | 172/815 |
| 7,584,557 | B1 * | 9/2009 | Nistler | E01H 5/065 | 37/234 |
| 7,730,644 | B2 * | 6/2010 | Frey | E01H 5/066 | 37/274 |
| 8,096,066 | B2 * | 1/2012 | Gandolfi | E01H 5/065 | 172/815 |
| 8,393,406 | B2 | 3/2013 | Seal | | |
| 9,388,544 | B2 * | 7/2016 | Reeves | E01H 5/065 | |
| 2013/0185962 | A1 * | 7/2013 | Reeves | E01H 10/007 | 37/231 |
| 2016/0060833 | A1 * | 3/2016 | Shubs, Jr. | E01H 8/10 | 37/197 |

FOREIGN PATENT DOCUMENTS

| | | | |
|---|---|---|---|
| CN | 102444102 | A | 5/2012 |
| EP | 1247906 | A3 | 11/2003 |

* cited by examiner

FRONT RETRACTING PLOW WITH SLIDING BLADE SECTIONS

FIELD OF THE INVENTION

This invention relates to ground ice scraping/removing plows carried by automotive tractors for clearing boardwalks from freezing rain ground ice and the like.

BACKGROUND OF THE INVENTION

In subfreezing climates such as in Canada, precipitations may include snow and freezing rain. When temperatures shift above and below the freezing point during day/night cycles, ground snow may melt as liquid water or slush during the day and re-freeze as ground ice during the night. Freezing rain also produces ground ice as it impacts ground. Ground ice on roads and boardwalks constitute a major hazard for automobiles and pedestrians, as it becomes very slippery. Typically, abrasive material such as sand or melting powders such as salt compounds can be used to mitigate ground snow. However, snow and ice scraping tractors are also needed to scrape snow and ice and push this scraped snow and ice sideways of the road or boardwalk, so as to attempt to remove surface ice. Ground snow is relatively easy to remove, but ground ice is much more difficult, at it "fuses" with the underlying ground asphalt or cement of the road or boardwalk. Municipalities have an official duty to make reasonable efforts in clearing snow and ice from boardwalks in particular, but as happens regularly, ground ice buildup can happen suddenly and temporarily overwhelm their ground ice clearing capabilities.

There have been identified deficiencies in the performance of conventional boardwalk ice scraping tractors. One deficiency is that ice scraping tractors have an unfortunate tendency to skid sideways of their travelling path and fall off from the boardwalk where they are working, as they sustain heavy shearing loads from the ground ice they are attempting to forcibly remove. Another deficiency is that the lower scraping leading edge of the plow blade can quickly become damaged because of the abuse from the shearing loads with hardened ground ice. Also, the weight of prior art ice scraping plows tend to be quite small, compromising their ground ice removing effectiveness.

SUMMARY OF THE INVENTION

The present invention is directed to snow plows that are particularly effective in the removal of ground ice on boardwalks, but not excluding ground snow and ice on roads. The present invention snow plow is divided into a number of separate sections, of which the intermediate section is stationary while the other sections are movable parallel to one another in a fore and aft direction, wherein the plow ground engaging leading edges remain at all times at 90° angle relative to the boardwalk or road. This in turn enables to substantially decrease the lateral skidding bias of the tractor during sideways offloading of removed snow and ice over the boardwalk or road.

In one embodiment, there are five (5) plow sections, but there could be three, or seven, or more plows, all mounted to an overlying rigid platform being used as a supporting frame; the lateral (non stationary) plow sections are slidably carried in fore and aft direction by a pivotal linkage assembly powered by hydraulic rams.

In one embodiment, the lower edge portion of each plow section includes a collapsible spring biased leading edge portion, that yields rearwardly toward an inoperative position against the bias of the spring biasing means upon a hardened ground obstacle being struck, but that returns to its forward operative position under bias from spring means once this hardened ground obstacle has been cleared.

In one embodiment, each plow lower leading edge portion is angularly adjustable, to optimize the scraping angle of attack of the ice removing plow.

Each boardwalk clearing plow sections may have for example 25 centimeters (10 inches) in width, for a total of 125 cm (50 inches) in width for a boardwalk snow/ice clearing plow fitted with for example five plow sections. There is no gap between each successive pair of plow sections (other than that required for enabling free fore and aft sliding displacement of the plow sections relative to one another), so that the five plow sections act as one integral plow with respect to ground snow and ice capture and removal in a fore and aft movement of the plow carrying tractor. Substantially no ice or snow is allowed to pass in between any successive pair of plows during forward movement of the plow.

Therefore, the invention relates to a front retracting plow comprising a vehicle mount for mounting the plow ahead of a tractor vehicle, a plow frame including an overlying platform releasably mounted to the vehicle mount, a stationary intermediate blade pivotally mounted to said platform and at least one pair of opposite first and second lateral blades, slidably mounted to said platform along sliding grooves therein, means for mounting said intermediate blade to said lateral blades for non-translational relative movement of each one of said first and second lateral blades relative to said intermediate blade for travel in independently controlled opposite fore and aft paths parallel to each other, and a pivotal linkage arm assembly interconnecting said at least one pair of lateral blades to said intermediate blade and for continuous sliding operational motion of said lateral blades parallel to one another in opposite directions between an intermediate position, where all lateral blades and intermediate blade are transversely aligned, a first limit position where said first lateral blade of each pair of said lateral blades is at a rearwardmost limit position and said second lateral blade of each pair of said lateral blades is at a frontwardmost limit position, and a second limit position, where said first lateral blade of each pair of said lateral blades is at a frontwardmost limit position and said other of each pair of said lateral blades is at a rearwardmost limit position, wherein a laterally continuous forward ground scraping action is achieved between all said lateral blades and said intermediate blade.

A hydraulic ram power means is preferably provided, power operating said pivotal linkage arm assembly.

In one embodiment, there are two pairs of said lateral blades.

In one embodiment, each said intermediate blade and each of said lateral blades define a bottom edge portion, and further including secondary blades each mounted for relative movement at a pivot mount to said bottom edge portion of each of corresponding said intermediate blade and said lateral blades, biasing means biasing said secondary blades in an operative downwardly forwardly inclined ground engaging condition but capable of yielding responsively to excess loads sustained to move to an inoperative downwardly rearwardly inclined ground clearing condition.

In one embodiment, adjustment means are provided for adjusting the angular value of said secondary blade in said operative ground engaging condition thereof. Said angular value adjusting adjustment means could include a hydraulic ram interconnecting a top portion of the vehicle mount to a lower portion of the platform, said ram defining a socket and a piston rod, and a threaded complementary endless screw type interconnection being provided between an intermediate section of said piston rod with the bottom portion of said socket. In operating condition, the ram is in a float position; the rod and socket move freely to allow up and down movement thereof to follow ground contour changes.

In one embodiment, slider carriage plates are mounted over each platform sliding grooves, between said lateral blades and said pivotal linkage arm assembly, and clamping said blade members and keeping them parallel with respect to a vertical plane longitudinal to the tractor.

In one embodiment, adjustment means are provided for adjustment of the load of the coil springs, said load adjustment means being of the endless screw type interconnection between a bottom end portion of said rod and a pivotal assembly socket mounted to a rearward portion of a corresponding said secondary blade. The angular value between said secondary blade and a vertical plane intersecting said secondary blade pivot mount widthwise of said plow in operative condition of said scraping blade could be about 10°.

A ground engaging shoe could be provided, pivotally mounted to an underside portion of each said secondary blade

DETAILED DESCRIPTION OF THE EMBODIMENTS OF THE INVENTION

Figure 1:
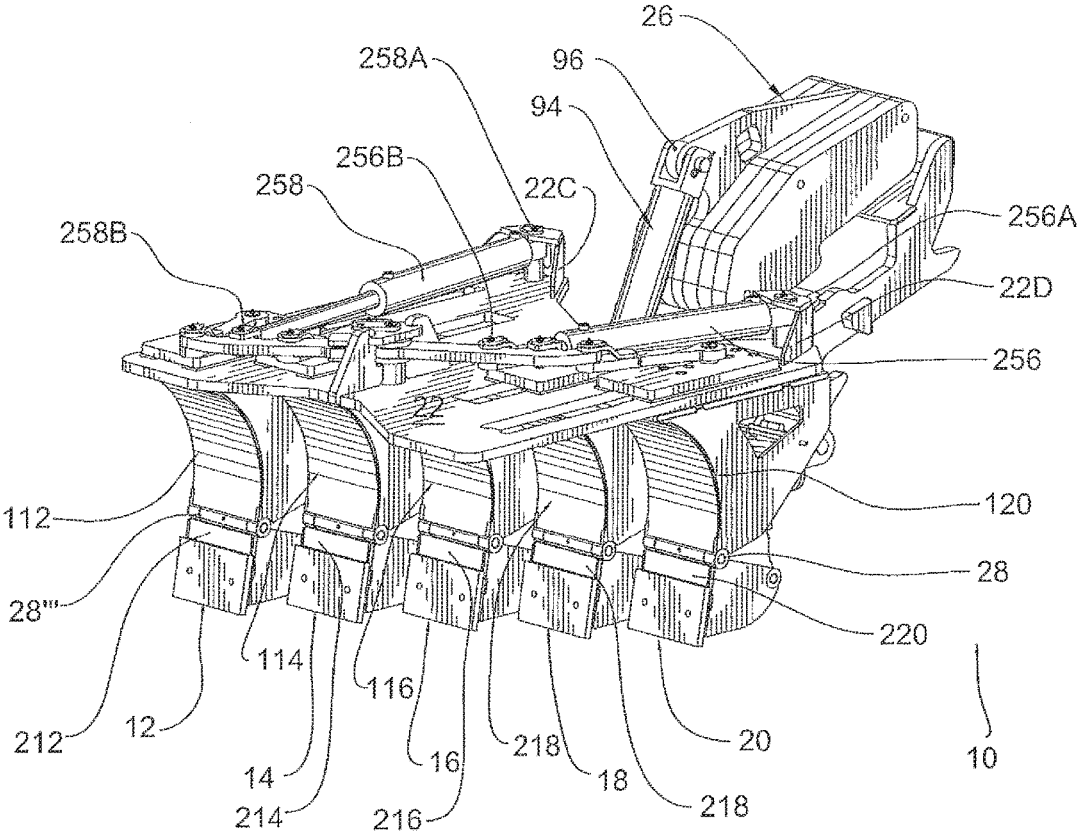
FIG. 1 is a perspective view of a front retracting snow/ice plow with five main blade sections according to one embodiment of the invention, and also showing the plow mount assembly for attachment to a tractor (not shown)

The front retracting snow and ice plow 10 of FIGS. 1-6 comprises a number of ground engageable main blade members, for example five main blade members or plow sections 12, 14, 16, 18 and 20, as illustrated. Each blade member 12-20 is operatively mounted to an overlying platform 22 and to each other via a pivotal linkage means 24. Side wings 22A of platform 22 are pivotally mounted to a vehicle mount 26 via rearward downwardly mounted pivot mount assembly 27 (FIG. 6) and operatively mounted to an upwardly mounted ram means 94.

A vehicle mount 26 operatively interconnects the platform 22 to a tractor vehicle, not illustrated.

Each one of the blade members 12-20 includes a main blade 112-120, a bottom secondary scraper blade 212-220, and means 28, 28', 28", 28''', 28'''' therebetween for relative movement of each main blade 112-120 with their corresponding secondary scraper blade 212-220. Each main blade 112-120 defines an open main body 30, having a top flat bed 32, a front arcuate (concave) wall 34, two opposite side walls 36, 36, and an open enclosure 40. The main blade top leading edge 34A where the front edge of top flat bed 32 merges with the top edge of arcuate front wall 34, is forwardly offset relative to the bottom edge 34B of arcuate wall 34. Each bottom secondary scraper blade 212-220 defines a generally U-shape open main body 42, with a front flat quadrangular wall 44 and two integral opposite side walls 46, 46.

Figure 4:
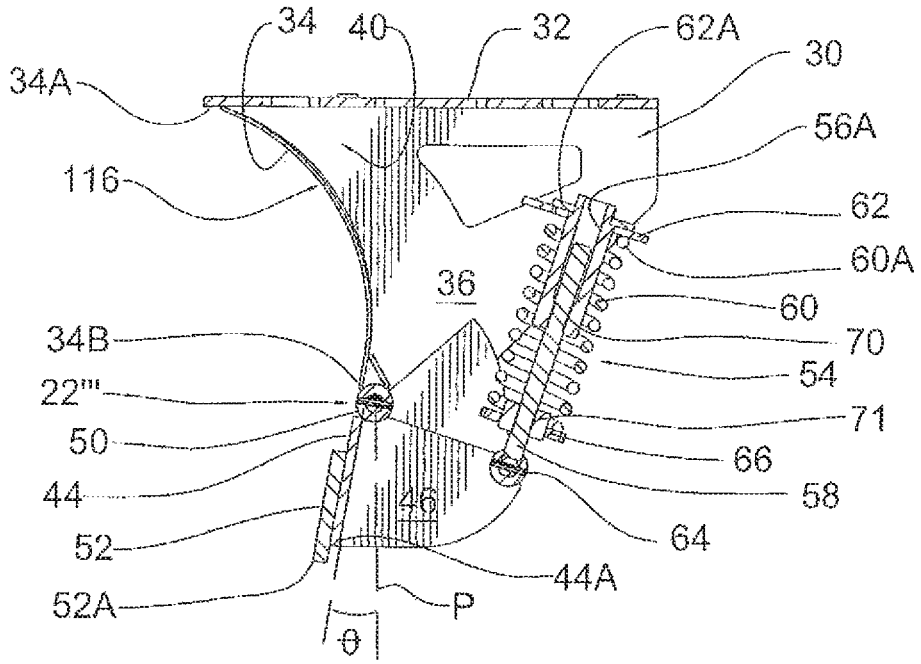
FIGS. 4 and 5 are enlarged vertical sectional views of one main blade section and associated bottom pivotable secondary scraper blade and biasing spring mount from the embodiment of FIG. 1, sequentially suggesting the rearward play of the secondary scraper blade section against the biasing force of the biasing coil spring upon striking a hardened ground obstacle.
Figure 5:
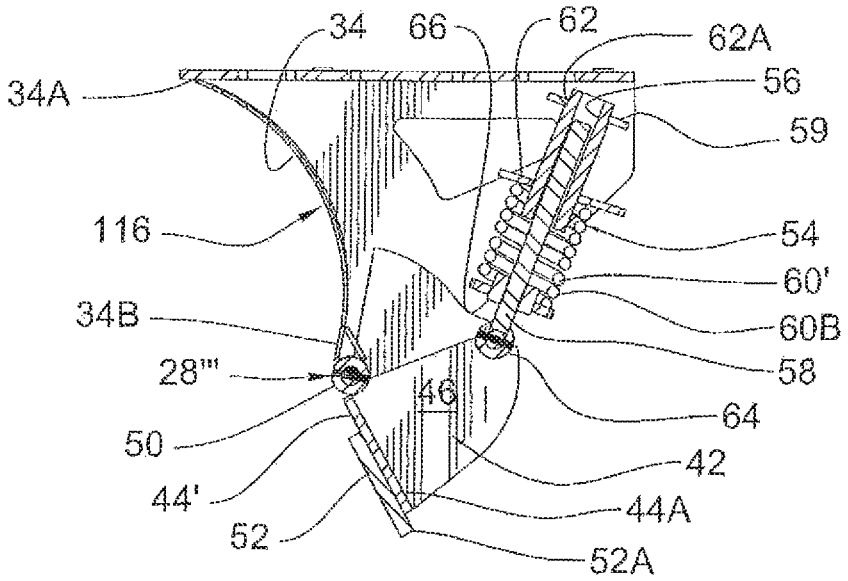

In one embodiment, the means for relative movement 28 consists of a transverse horizontal pivotal mount 50 pivotally interconnecting the top edge of scraper blade wall 44 with the bottom edge 34B of main blade arcuate wall 34, wherein as illustrated in FIGS. 4 and 5, the U-shape main body 42 may pivot from a first extended operative condition, shown in FIG. 4, where scraper blade wall 44 is generally coextensive to the lower edge portion of main blade arcuate wall 34 in a downwardly forwardly inclined fashion, to a second retracted inoperative condition, shown as 44' in FIG. 5, where U-shape body 42 is tilted rearwardly partly inside said main blade enclosure 40 and where said scraper blade wall 44 is not coextensive to main blade arcuate wall 34 but rather extends downwardly rearwardly from pivot mount 50. In particular, blade 44 shifts from a forwardly downwardly inclined operative condition (FIG. 4) to a rearwardly downwardly inclined condition (FIG. 5) passing through a vertical plane P intersecting the pivot mount 50 widthwise of the plow 10.

Figure 4A:
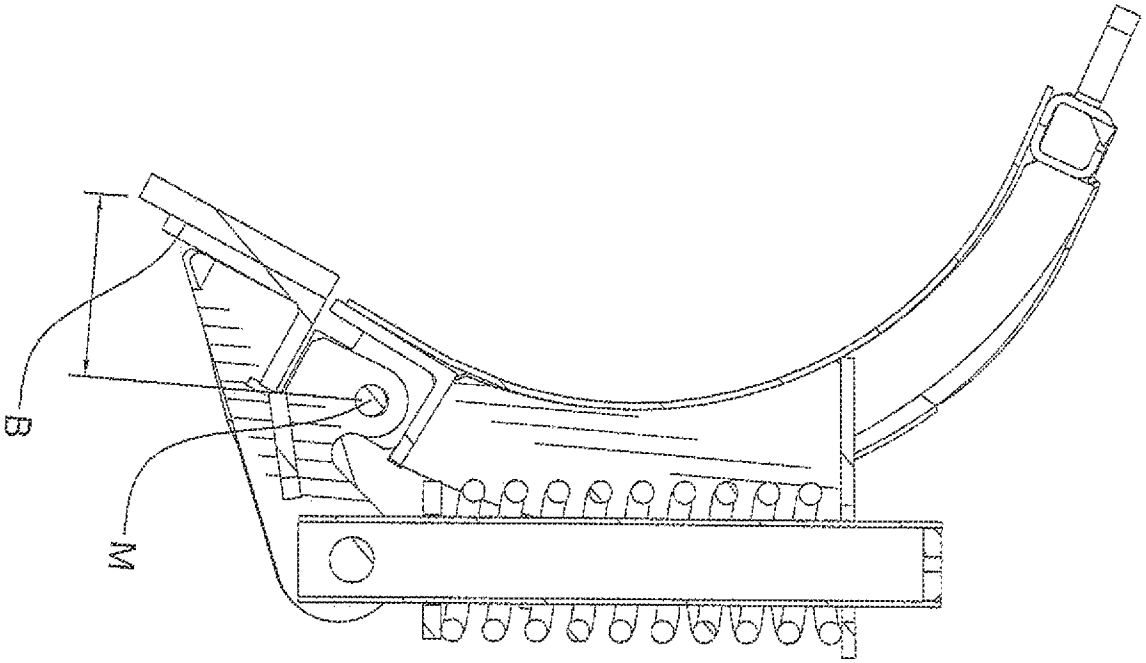
PRIOR ART Fig. 4A
FIG. 4A is a view similar to FIG. 4 but showing a prior art plow.

It is particularly noted that such a shift through the vertical widthwise plane crossing pivot mount 50 is not possible in prior art plows (see FIG. 4A) since their corresponding pivot mount M is located too far rearwardly from the lower leading scraping blade B in a structurally limiting fashion.

Accordingly with the present invention, optimized load bearing of the main blade 34 over the collapsible lower blade 44 can be achieved unexpectedly relative to prior art devices.

Accordingly, this angular play of scraper blade wall 44 relative to the bottom edge portion 34B of arcuate blade wall 34 accommodates ground obstacles which could otherwise damage the plow equipment.

To the front outer exposed surface of scraper blade wall 44 is fixedly mounted a hardened ice scraping plate 52. Plate 52 includes a strong bottom sharpened lip 52A projecting beyond the radially outer bottom edge 44A of scraper blade wall 44 radially outwardly relative to pivot mount 50. Lip 52A is of such construction and shape as to be able to withstand repeated shearing action against hard ice on the ground.

The angular play capability of scraper blade wall 44 relative to the arcuate blade wall 34 is controlled by a biasing means 54. In one embodiment, biasing means 54 includes cylindroid socket 56 and a piston rod 58 movable inside axial boring 56A of socket 56. Socket 56 and piston rod 58 are mounted within main blade enclosure 40. Both socket 56 and piston rod 58 are engaged lengthwisely radially inwardly of a compression coil spring 60. A stopper seat 62 is made transversely integral to main blade body side wall 36 and freely engaged through stopper seat bore 62A by the top outer end portion of socket 56. Stopper seat 62 is sized and shaped for retaining abutting engagement by the top end 60A of coil spring 60. A flange 59 diametrally smaller than seat 62 but diametrally larger than seat bore 62A is made integral to the top end of socket 56, so that stopper seat 62 be taken in sandwich between flange 59 and top end 60A of coil spring 60. The bottom outer end portion of piston rod 58 is pivotally mounted at pivot mount 64 to lower edge portion of side walls 46, 46, of U-shape secondary scraper blade 42, generally opposite wall 44 and associated blade plate 52. A second stopper socket 66 is transversely mounted to the lower end portion of piston rod 58 closely spacedly proximate pivot mount 64, with stopper 66 made integral to flange 59 and sized for retaining abutting engagement by the bottom end 60B of coil spring 60.

In one embodiment, stopper socket 66 and rod 58 are interconnected by threaded intermeshing spiralling grooves and ribs assembly, 71, (i.e. an endless screw interconnection) of outer surface of rod 58 and inner groove surface of stopper socket 66, thus forming an adjustable coil spring tensioning device.

Accordingly, in the operative condition of FIG. 4, the coil spring 60 is extended, pushing against top stopper seat 62 and biasing bottom scraper blade body 42 via pivot 64 in a clockwise rotation about pivot mount 50.

On the other hand, as shown in FIG. 5, upon an excessive load being applied at blade plate lip 52A, bottom scraper blade body 42 will yieldingly pivot in counter clockwise fashion about pivot mount 50, thereby compressing coil spring at 60' against stopper seat 62. That is to say, when spring 60 is compressed at state 60' shown in FIG. 5, rod 58 and lower socket 66 and upper socket 56 are threaded together and become integral as one and move upwardly together.

Figure 6:
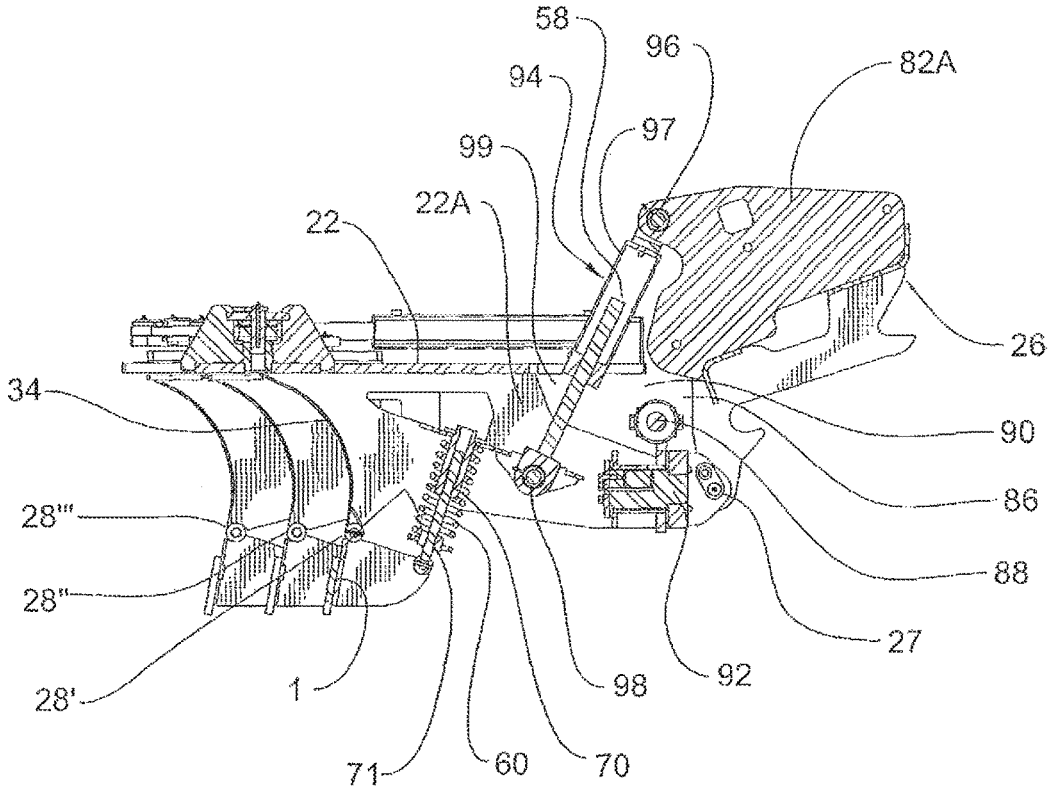
FIG. 6 is vertical sectional view of the front retracting plow of FIG. 1 with three main blade sections and associated vehicle mount assembly, and further showing two endless screw adjustment means of the ram member interconnecting the vehicle mount assembly with the plow main body, the piston of the latter ram member not shown.

As shown in FIG. 6, according to one embodiment of the invention, there is further provided means 70 for adjusting the operative angular leading edge value of scraper blade 44 relative to the lower end portion of main blade arcuate wall 34. Means for angular adjustment 70 may be for example a threaded complementary interconnection (e.g. endless screw interconnection of intermeshing spiralling grooves and ribs assembly) between a diametrally smaller outer intermediate section of piston rod 58 and a diametrally larger inner intermediate section of socket 56.

Figure 2:
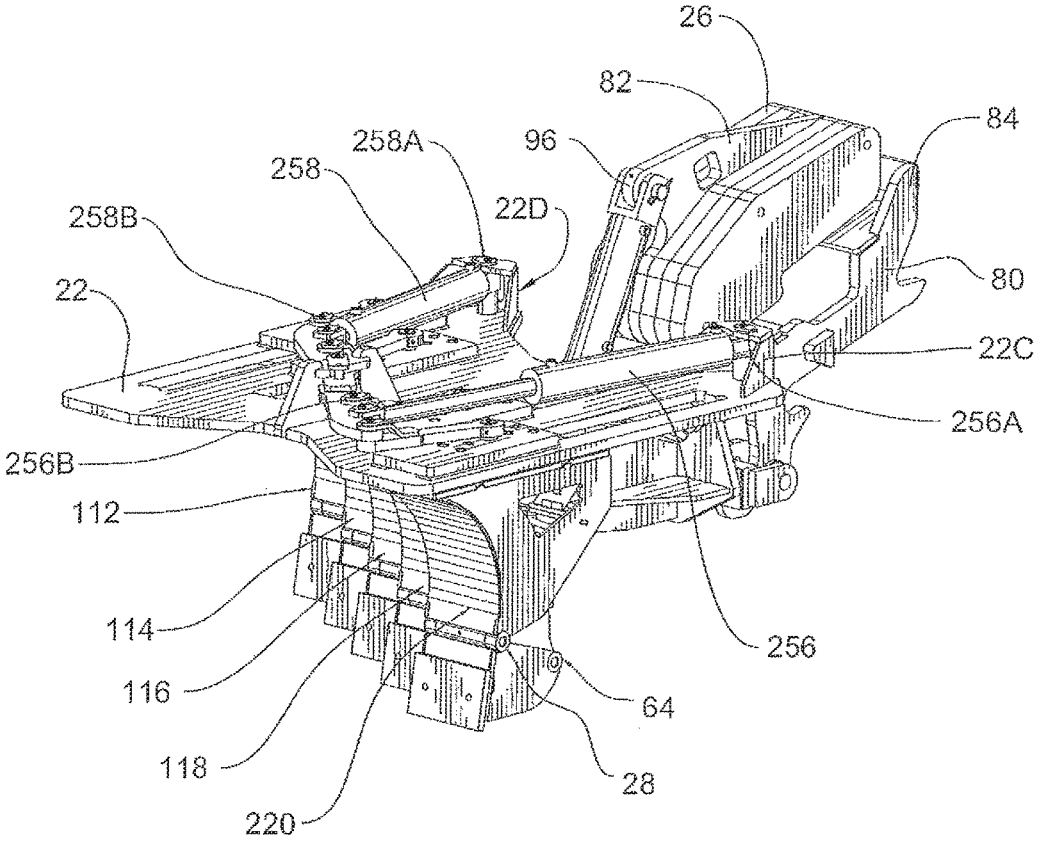
FIG. 2 is a view similar to FIG. 1 but with two pairs of lateral blade sections shifted from the first limit position of FIG. 1 to a second limit position opposite the first limit position.

As best shown in FIGS. 1-2 and 6 of the drawings, flat platform 22 includes a pair of transverse structural trusses 80. Vehicle mount 26 includes a main frame 82 with one end portion 84 for mounting to an automotive tractor, and with an opposite end portion 86 mounted for relative movement at 88 to a carriage 90 integral to platform trusses 80. In one embodiment, these means for relative movement 88 consists of a horizontal transverse pivotal mount interconnecting two fore and aft frame arms 82A, 82A with a yoke member 92 integral to the aft end portions of platform trusses 80. A downwardly forwardly inclined hydraulic ram 94 interconnects a top pivotal portion 96 of vehicle mount frame 82 with a bottom pivotal portion 98 anchored to platform trusses 80, for lifting the snow/ice plow blades 12-20 over ground. Ram 94 defines a cylinder 97 and a downwardly projecting piston rod 99.

Figure 3:
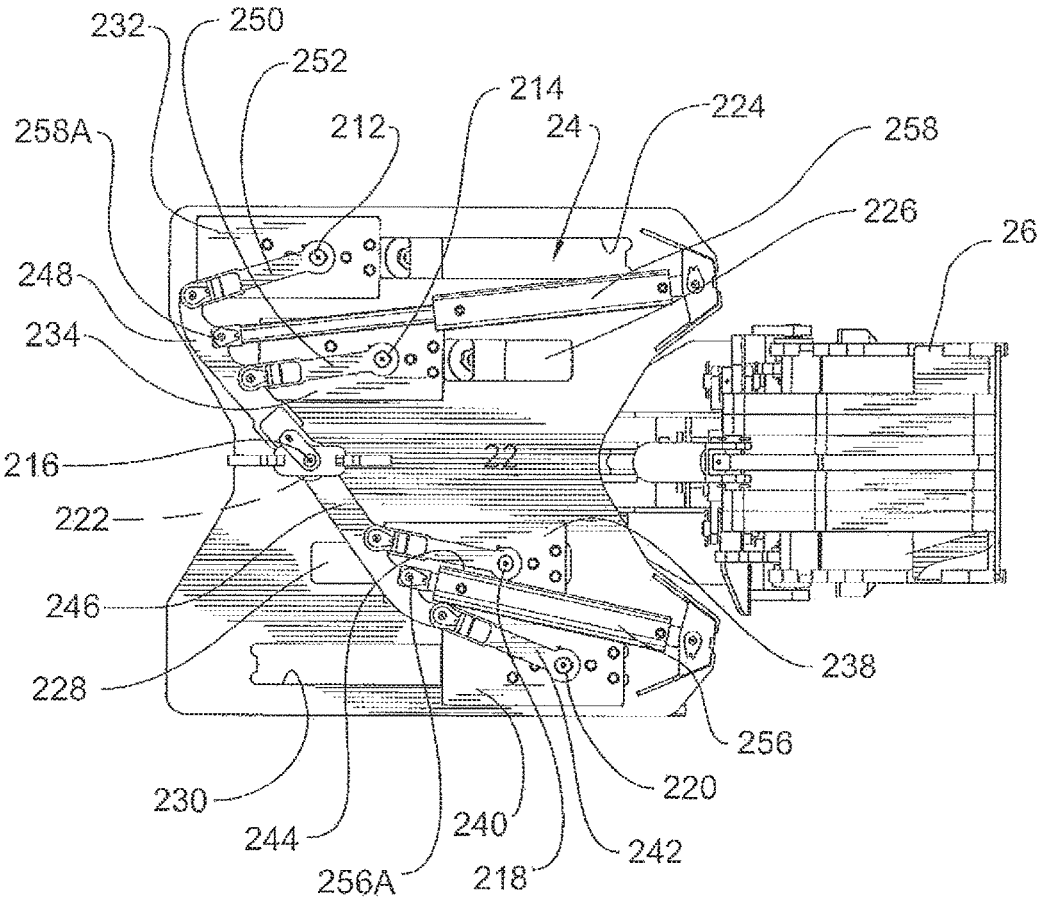
FIG. 3 is a top plan view of the front retracting plow of FIG. 1.

As best illustrated in FIGS. 1 to 3, intermediate blade 116 is stationary while opposite blades 114, 118, and 112, 120, are mounted to platform 22 with means for relative fore and aft movement to one another in a non-translational way. The first pair of lateral blades 114 and 118 move parallel to one another in opposite directions, while the second pair of lateral blades 112 and 120 also move parallel to one another in opposite directions. In particular, the top horizontal wall 32 (FIG. 4) of all main blade main bodies 30 is pivotally connected to platform 22 by a pivot means 212, 214, 216, 218 and 220. Pivot means 216 of intermediate blade 116 extends through a bore 222 forwardly intermediate of platform 22, while pivot means 212, 214, 218 and 220 extend through corresponding fore and aft extending grooves 224, 226, 228 and 230 in register with corresponding blades 112, 114, 118 and 120. In one embodiment, each pivot means 212, 214, 218 and 220 includes a slider carriage plate 232, 234, 238 and 240 overlying flat platform 22 and used to clamp blade members 112, 114, 116, 118, 120 and keep them parallel with respect to a vertical plane longitudinal to the tractor. All pivot means 212, 214, 216, 218, and 220 are interconnected by pivotal linkage arms 242, 244, 246, 248, 250, 252. Each pair of pivot means 214 and 218, and 216 and 220 are power operated by independently controlled hydraulic rams 256, 258, respectively, pivotally anchored at one cylinder aft end 256A, 258A, to rear platform ear 22C and 22D, and at the opposite fore piston rod end 256B, 258B, to intermediate sections of the pivotal linkage arms 246-248.

It is noted from FIG. 4 that the angular value θ made between forwardly downwardly inclined ice scraping plate 52 (in operative condition) and a vertical plane P intersecting pivot mount 50 widthwise of plow is small, for example about 10° as illustrated. A small angle θ optimizes performance of the present snow/ice plow, as the pivot mount 50 is almost in overhanging position relative to scraping leading plate 52, thus providing best blade load bearing over ground, contrary to prior art arrangements (FIG. 4A) where the corresponding pivot mount M is rearwardly offset and the angular value is for example 30° or more with the ground scraping leading blade B.

The first embodiment of snow plow as shown has five arcuate blades 12, 14, 16, 18, and 20. However, other uneven number of arcuate blades could also be within the scope of the invention, with a minimum of three arcuate blades: for example, seven or nine blades.

In one embodiment, the present snow plow is especially useful to clear ground ice, but can also be used for hardened snow and ice on the boardwalk of cities with subfreezing climates.

Figure 7:
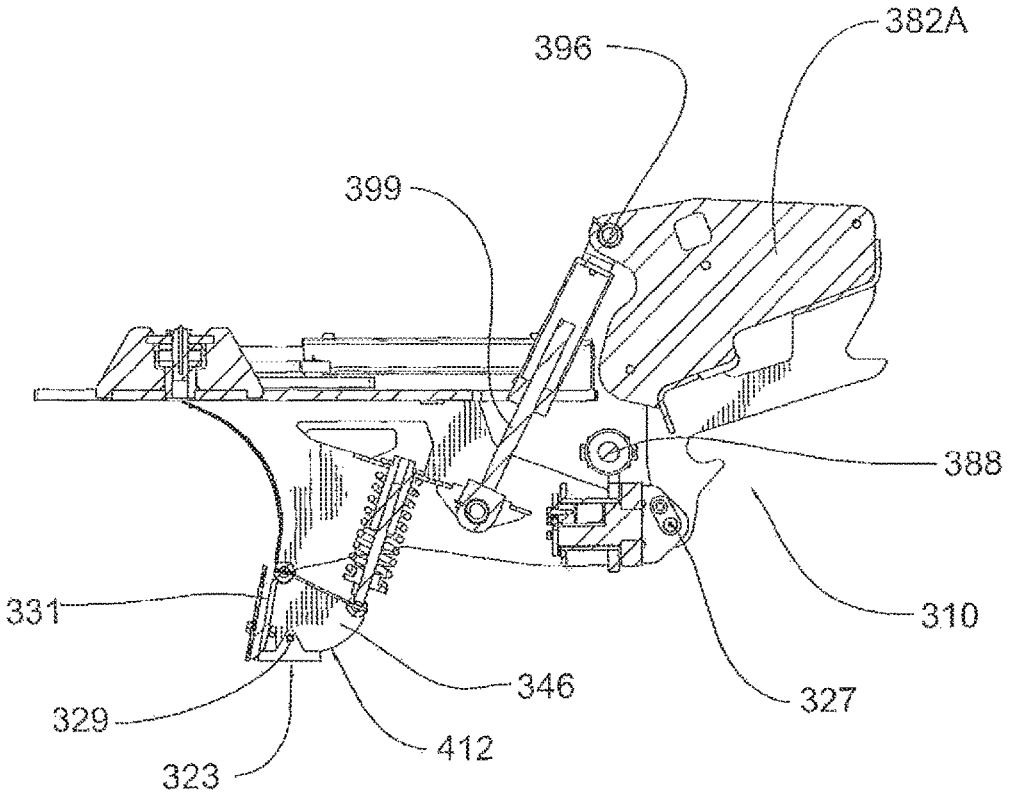
FIG. 7 is a view similar to FIG. 6 but with all plows being transversely aligned and showing another embodiment of plow.
Figure 8:
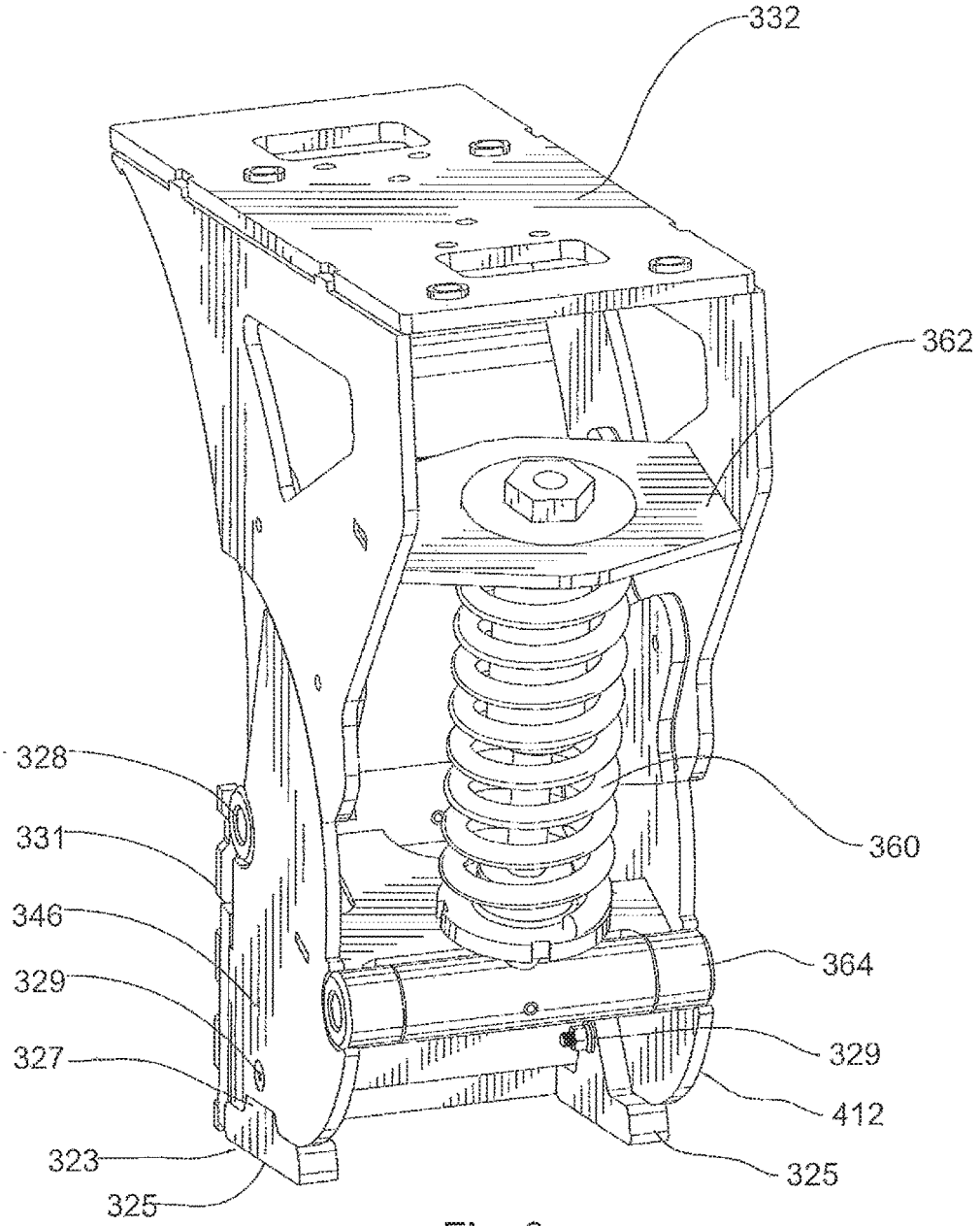
FIG. 8 is an enlarged perspective forwardly looking view of one of the plows and associated pivotal secondary blade biasing means from the embodiment of FIG. 7.
Figure 9:
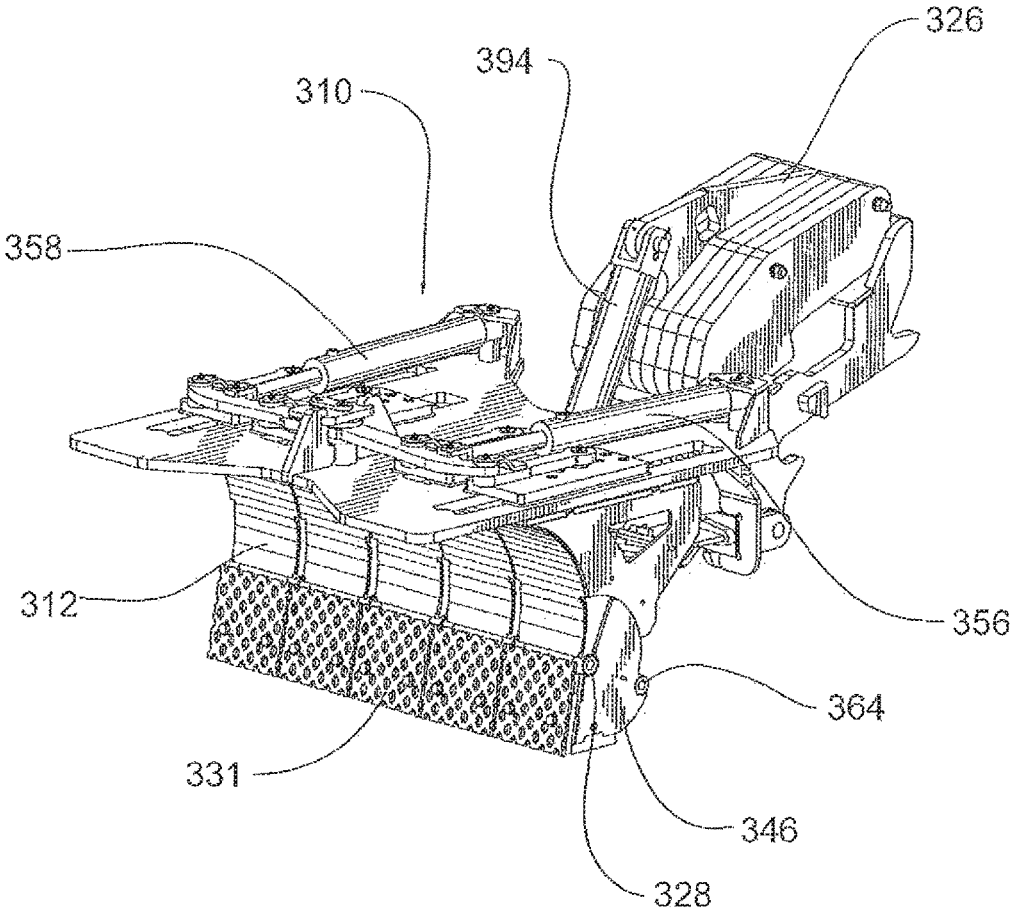
FIG. 9 is a view similar to FIG. 2 but showing the embodiment of FIG. 7 at a slightly smaller scale and showing all plows transversely aligned.

In another embodiment of snow plow of FIGS. 7 to 9, each of the secondary scraper blades 412 is fitted with a ground engaging shoe 323. Each shoe 323 defines a flat elongated plate 325 with an intermediate transversely upwardly projecting ear 327. A horizontal transverse pivot mount 329 pivotally interconnects ear 327 with side walls 346 of each secondary scraper blades 412. A perforated shield grate 331 is preferably mounted in one embodiment ahead of each leading scraping blade of secondary blade 412.

Other components in the 300 series of this another embodiment remain the same as in the first embodiment are all identified accordingly in the drawings, including pivot mounts 328 and 364, coil spring 360, stopper seat 362 and main body top wall 332.

I claim:

1. A front retracting plow comprising a vehicle mount for mounting the plow ahead of a tractor vehicle, a plow frame including an overlying platform releasably mounted to the vehicle mount, a stationary intermediate blade pivotally mounted to said platform and at least one pair of opposite first and second lateral blades, slidably mounted to said platform along sliding grooves therein, means for mounting said intermediate blade to said lateral blades for non-translational relative movement of each one of said first and second lateral blades relative to said intermediate blade for travel in independently controlled fore and aft paths parallel to each other, and a pivotal linkage arm assembly interconnecting said at least one pair of lateral blades to said intermediate blade and for continuous sliding operational motion of said lateral blades parallel to one another in opposite directions between an intermediate position, where all lateral blades and intermediate blade are transversely aligned, a first limit position where said first lateral blade of each pair of said lateral blades is at a rearwardmost limit position and said second lateral blade of each pair of said lateral blades is at a frontwardmost limit position, and a second limit position, where said first lateral blade of each pair of said lateral blades is at a frontwardmost limit position and said other of each pair of said lateral blades is at a rearwardmost limit position, wherein a laterally continuous forward ground scraping action is achieved between all said lateral blades and said intermediate blade.

2. A front retracting plow as in claim 1,
further including hydraulic ram power means power operating said pivotal linkage arm assembly.

3. A front retracting plow as in claim 2,
wherein there are two pairs of said lateral blades.

4. A front retracting plow as in claim 2,
wherein each said intermediate blade and each of said lateral blades define a bottom edge portion, and further including secondary blades each mounted for relative movement at a pivot mount to said bottom edge portion of each of corresponding said intermediate blade and said lateral blades, biasing means biasing said secondary blades in an operative downwardly forwardly inclined ground engaging condition but capable of yielding responsively to excess loads sustained to move to an inoperative downwardly rearwardly inclined ground clearing condition.

5. A front retracting plow as in claim 4,
further including adjustment means for adjusting the angular value of said secondary blade in said operative ground engaging condition thereof.

6. A front retracting plow as in claim 5,
wherein said angular value adjusting adjustment means includes a hydraulic ram interconnecting a top portion of the vehicle mount to a lower portion of the platform, said ram defining a socket and a piston rod, and a threaded complementary endless screw type interconnection being provided between an intermediate section of said piston rod with the bottom portion of said socket, wherein in an operating condition of said ram, said ram is in float position, the rod and socket moving freely to allow up and down movement thereof to follow ground contour changes.

7. A front retracting plow as in claim 4,
further including slider carriage plates mounted over each platform sliding grooves, between said lateral blades and said pivotal linkage arm assembly, and clamping said blade members and keeping them parallel with respect to a vertical plane longitudinal to the tractor.

8. A front retracting plow as in claim 6,
further including adjustment means for adjustment of the load of the coil springs, said load adjustment means being of the endless screw type interconnection between a bottom end portion of said rod and a pivotal assembly socket mounted to an rearward portion of a corresponding said secondary blade.

9. A front retracting plow as in claim 8,
wherein the angular value between said secondary blade and a vertical plane intersecting said secondary blade pivot mount widthwise of said plow in operative condition of said scraping blade is about 10°.

10. A front retracting plow as in claim 4,
further including a ground engaging shoe, pivotally mounted to an underside portion of each said secondary blade.

* * * * *